United States Patent [19]

Scalli

[11] Patent Number: 4,967,874

[45] Date of Patent: Nov. 6, 1990

[54] MICROPHONE BAFFLE APPARATUS

[76] Inventor: Jeffrey R. Scalli, 1816 Irlo Dr., Kissimmee, Fla. 32741

[21] Appl. No.: 435,161

[22] Filed: Nov. 13, 1989

[51] Int. Cl.[5] ..... G10K 13/00

[52] U.S. Cl. ..... 181/158; 181/171; 181/175; 181/242; 381/169; 381/188; 381/205

[58] Field of Search ..... 181/157, 158, 148, 146, 181/141, 175, 242, 287, 171; 381/158, 169, 189, 188, 205

[56] References Cited

U.S. PATENT DOCUMENTS

| | | | |
|---|---|---|---|
| 2,263,408 | 11/1941 | Lakhovsky | 181/242 |
| 2,855,067 | 10/1958 | Di Mattia | 181/242 |
| 2,976,948 | 3/1961 | Thiessen et al. | 181/242 |
| 3,154,171 | 10/1964 | Knutson et al. | 181/158 |
| 4,522,283 | 6/1985 | Smith | 181/242 X |
| 4,625,828 | 12/1986 | Shivashankara et al. | 181/175 |
| 4,658,932 | 4/1987 | Billingsle | 181/175 |
| 4,805,728 | 2/1989 | Carter et al. | 181/141 |

*Primary Examiner*—Benjamin R. Fuller
*Attorney, Agent, or Firm*—William M. Hobby, III

[57] ABSTRACT

A microphone baffle apparatus having a baffle member having first and second sides with the first side shaped to form a sound baffling surface to absorb sound energy. The baffle member has an opening therethrough in the center portion thereof and has an elastic material attached around the opening so that a microphone can be slipped through the opening and the baffle member held to the microphone by the elastic material around the opening. The baffle member may be made of a plurality of sectors connected with ductile hinges to allow the baffle member to be bent into a plurality of shapes. In addition, each baffle sector may be made of a plurality of laminated layers of ductile material and bent to a variety of desired shapes. One layer may be a thin layer of lead and one side of the baffle may have a waffle shaped surface thereon.

9 Claims, 1 Drawing Sheet

MICROPHONE BAFFLE APPARATUS

BACKGROUND OF THE INVENTION

The present invention relates to microphone baffles and especially to a microphone baffle which can be slipped over a microphone and held thereto and bent to a variety of shapes.

In the past, various types of microphones have been utilized and typically a microphone has a housing which includes a handle which has a transducer, such as a moving coil in a dynamic microphone, at one end of the housing and is generally covered by a diaphragm and windscreen. The microphone housing may be attachable to a stand for holding the microphone in place for use by an individual and may include a cable for connecting to a sound system or, alternatively, may be a transmitting remote microphone. Microphones typically come with a variety of windscreens mounted around the diaphragm and transducer portion thereof for shielding the microphone against wind noise and the like. It has also been common for professionals in the use of microphones to make various types of baffles out of corrugated board or the like for shielding the microphone in one or more directions from a musical instrument or extraneous noise. Baffles for sound energy have also been utilized within rooms to breakup the sound by the absorption of energy and may use a sound absorbing surface which can sometimes be a waffle shaped material such as a foamed polymer. It has also been known in the past to .PN2utilize sound blocking materials for blocking the passage of sound through a wall. Typically a sound blocking material uses a material which has a resonance below the normal hearing threshold for humans. Typical sound blocking materials may be solid concrete or may be a thin sheet of lead, both of which materials resonate at such a low frequency as to produce no sound to the human ear on the other sound thereof.

Prior art patents which have microphones using various types of windscreens or baffles include the Knutson et al. U.S. Pat. No. 3,154,171 which shows a noise pressing filter for a microphone. The Billingsley U.S. Pat. No. 4,658,932 is for a simulated binaural recording system having a pair of planar barriers positioned at selected angles. The Di Mattia U.S. Pat. No. 2,855,067 is for a sound shielding housing for a microphone, such as used in a large number of sound shielding devices for telephone receivers, transmitters and the like. The Thiessen et al. U.S. Pat. No. 2,976,948 is a mechanical device for assisting in the discrimination of sounds while the Lakhovsky U.S. Pat. No. 2,263,408 improves the sound emitted by microphone and has a surrounding shield in one embodiment.

The present invention is for a universal microphone baffle which can be slipped onto the microphone and held in place and positioned in a variety of shapes and may include a sound blocking material therein for blocking and absorbing and conditioning the sound arriving at the microphone from different directions as determined by the positioning of the microphone and by the shaping of the microphone baffle.

SUMMARY OF THE INVENTION

The present invention relates to a microphone baffle and sound blocking attachment for a microphone. A baffle member has first and second sides with the first side having a shaped sound baffling surface to absorb sound energy. The baffle member has an opening therethrough in the center portion thereof and has an elastic material attached around the opening in the baffle member so that the microphone diaphragm can be slipped therethrough and the baffle member supported to the microphone housing by the elastic material around the opening. The baffle member may be a plurality of connected sectors connected by ductile hinges to allow the pieces to be bent on the ductile hinges into different shapes. Each sector may be made of a plurality of laminated ductile material which can be further bent to any shape desired and may have a generally circular perimeter. A plurality of ductile layers of material may include a sound blocking layer, such as a thin layer of lead, while one of the sides may include a surface layer of waffle shape sound conditioning material, such as a foamed polymer material, such as foamed polyurethane. The baffle member may have a circular perimeter and may be formed in a generally semi-spherical shape having a waffle shaped surface on the inside thereof for shielding the microphone diaphragm from direct emanating sounds while baffling the sound around the microphone.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
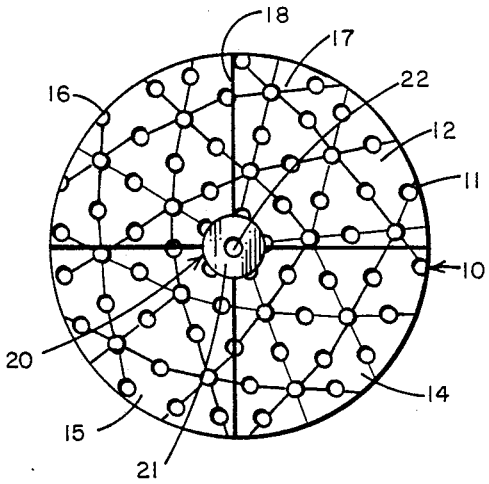
FIG. 1 is a front elevation of a microphone baffle in accordance with the present invention.
Figure 3:
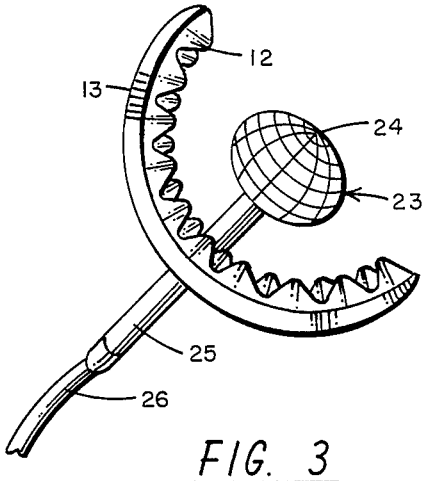
FIG. 3 is a sectional view of the microphone baffle of FIGS. 1 and 2 attached to a microphone.
Figure 2:
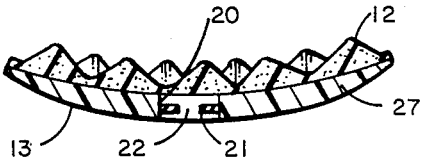
FIG. 2 is a sectional view taken through the microphone baffle of FIG. 1.
Figure 5:
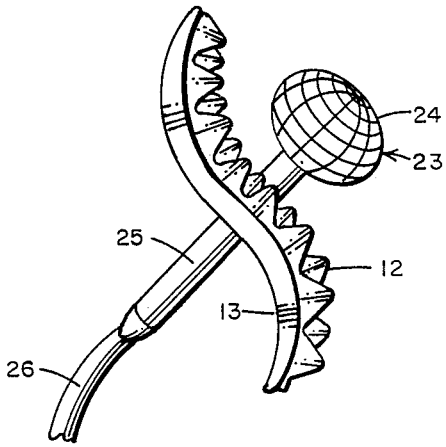
FIG. 5 is a sectional view of a microphone baffle in accordance with FIGS. 1 through 4 attached to a microphone and bent to form a different shape.
Figure 4:
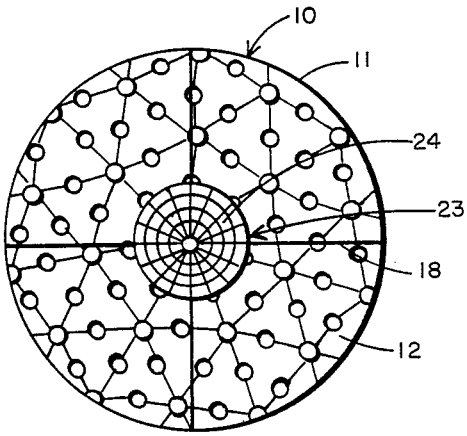
FIG. 4 is a front elevation of the microphone baffle of FIGS. 1 through 4 attached to a microphone.

Referring to the drawings and especially to FIGS. 1 through 4, a microphone baffle 10 in accordance with the present invention has a circular periphery 11 with a front side 12 having a waffled sound absorbing material, and having a smooth rear side 13. The microphone baffle is made up of four sectors 14, 15, 16, and 17 each connected by a flexible ductile hinge 18, such as a thin strip of aluminum, and forming a circular center opening 20 having an elasticized material, such as a flexible rubber portion 21, having a center opening 22. The flexible material 21 allows a microphone 23, head 24 to be slipped through the opening 22 with the elastic material 21 holding the baffle 10 to the microphone housing 25. The microphone housing 25 has a cable 26 extending therefrom. The microphone head 24 includes a diaphragm having a transducer, such as a moving coil in a dynamic microphone located inside the diaphragm. The microphone baffle 10 may have the sound absorbing waffle shaped material 12 made of a polystyrene foam or polyurethane foam giving a shape, such as shown with a plurality of hills and valleys, for better absorption of the sound energy on the one side while the other side 13 may have a smooth surface for the reflection of the sound energy and may be made of a ductile polymer or plastic, such as polystyrene or polyurethane,which can be bent to shape or can remain in the same semi-spherical shape as shown in FIGS. 1, 2 and 3. By having a foamed polymer material 12 and a ductile polymer material 27 attached thereto, the microphone baffle 10 can be left in the shape as shown in FIG. 3 or bent to any custom shape as shown in FIG. 5. In addition, the sectors 14, 15, 16, and 17 will each bend on the ductile hinge 18 which may be a thin strip of metal passing between the sections, such as a thin strip of aluminum, or may be made of a thin piece of lead which covers the entire surface as shown in FIG. 6.

Figure 6:
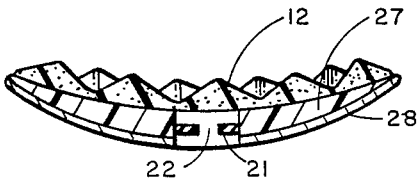
FIG. 6 is a sectional view of an alternate embodiment of a microphone baffle having a sound barrier of layer.

The laminated lead strip 28 in FIG. 6 has been laminated to the polymer layer 27 and to the waffling foamed polymer material 12 so that the foamed polymer material 12 conditions and absorbs the sound energy impinging thereupon while the thin lamination of lead 28 passes over the split areas 18 to form the hinges of a ductile material and also blocks the passage of sound energy therethrough and may have a smooth surface for reflecting the energy.

The elastic portion 21 allows the microphone head 23 to be pushed therethrough through the opening 22. As the elastic matrial 21 expands, it contracts onto the microphone housing 25 to support the microphone baffle 10 onto the microphone 23. This arrangement advantageously allows one microphone baffle to be used on most microphones of different design and also to be rapidly manipulated to a variety of shapes to exactly contour the sound by blocking the sound from one direction, such as between closely placed musical instruments while absorbing and conditioning the sound in the other direction to allow the audio energy to tailor the sound produced by the microphone transducer and the sound reproduced in a recording session.

It should also be clear that the waffled foamed polymer 12 can be placed on both sides of the microphone baffle if desired without departing from the spirit and scope of the invention to absorb sound energy on both sides of the microphone rather than reflecting and blocking the sound with a smooth surface. Accordingly, the present invention is not to be construed as limited to the forms shown which are to be considered illustrative rather than restrictive.

I claim:

1. A microphone baffle comprising:

a baffle member having first and second sides and an outer periphery and center portion, said first side having a shape to form a sound baffling surface to absorb sound energy, and said baffle member having an opening therethrough in the center portion thereof and having an elastic material attached to said baffle member around said opening therethrough, said baffle member having a plurality of connected sectors connected by ductile hinges to allow the sectors to be bent into a plurality of positions to form different shapes and to maintain a preset shape whereby a microphone can be slipped through said opening and said baffle member held to said microphone by said elastic material.

2. A microphone baffle in accordance with claim 1 in which said baffle member is formed of four sectors connected by ductile hinges and shaped to form a generally circular perimeter.

3. A microphone baffle in accordance with claim 1 in which said baffle member has a plurality of ductile layers of material, each layer being of a different material.

4. A microphone baffle in accordance with claim 3 in which said plurality of ductile layers of material include one layer of a sound blocking material laminated to at least one other layer of material.

5. A microphone baffle in accordance with claim 4 in which said one-layer of sound blocking material includes a layer of lead.

6. A microphone baffle in accordance with claim 4 in which said plurality of ductile layers of material include a surface layer of waffle shaped sound conditioning material.

7. A microphone baffle in accordance with claim 6 in which said plurality of ductile layers of material include one layer of foamed polyurethane.

8. A microphone baffle in accordance with claim 1 in which said baffle member is shaped to form a generally semi-spherical shape having a waffle shaped surface on said first side thereof.

9. A microphone baffle in accordance with claim 8 in which said second side of said baffle member has a smooth surface of sound reflecting material.

* * * * *